US007277071B2

(12) United States Patent
Oh

(10) Patent No.: US 7,277,071 B2
(45) Date of Patent: Oct. 2, 2007

(54) LUMINESCENT DISPLAY, AND DRIVING METHOD AND PIXEL CIRCUIT THEREOF, AND DISPLAY DEVICE

(75) Inventor: Choon-Yul Oh, Gunpo (KR)

(73) Assignee: Samsung SDI Co., Ltd, Suwon-si (KR)

( * ) Notice: Subject to any disclaimer, the term of this patent is extended or adjusted under 35 U.S.C. 154(b) by 477 days.

(21) Appl. No.: 10/734,003

(22) Filed: Dec. 10, 2003

(65) Prior Publication Data

US 2004/0145547 A1 Jul. 29, 2004

(30) Foreign Application Priority Data

Jan. 21, 2003 (KR) ..... 10-2003-0003975

(51) Int. Cl.
*G09G 3/30* (2006.01)

(52) U.S. Cl. ..... 345/76; 345/82; 315/169.1

(58) Field of Classification Search ..... 345/76–82, 345/169.4; 315/169.1, 169.3, 169.4
See application file for complete search history.

(56) References Cited

U.S. PATENT DOCUMENTS

| | | | | |
|---|---|---|---|---|
| 5,952,789 | A * | 9/1999 | Stewart et al. | 315/169.4 |
| 6,229,506 | B1 | 5/2001 | Dawson et al. | |
| 6,670,773 | B2 * | 12/2003 | Nakamura et al. | 315/169.3 |
| 7,019,717 | B2 * | 3/2006 | Yumoto et al. | 345/76 |
| 2001/0024186 | A1 | 9/2001 | Kane et al. | |
| 2002/0167472 | A1 * | 11/2002 | Jinno | 345/76 |

(Continued)

FOREIGN PATENT DOCUMENTS

JP 2003-108067 4/2003

(Continued)

OTHER PUBLICATIONS

Yumoto et al; "Pixel-Driving Methods for Large-Sized Poly-Si AM-OLED Displays"; Asia Display/IDW'01; Proceedings of the 21st International Display Research Conference in Conjunction with the 8th International Display Workshops, Nagoya, Japan, Oct. 16-19, 2001, vol. Conf. 21/8, pp. 1395-1398.

(Continued)

*Primary Examiner*—Richard Hjerpe
*Assistant Examiner*—Kimnhung Nguyen
(74) *Attorney, Agent, or Firm*—Christie, Parker & Hale, LLP

(57) ABSTRACT

In an exemplary embodiment of the present invention, there is provided a pixel circuit for a luminescent display, in which plural pixel circuits are formed in a plurality of pixels defined by a plurality of data lines and a plurality of scan lines. The pixel circuit includes: a luminescent element; a first capacitor; a first transistor having a gate electrode coupled to the first capacitor, and a first main electrode coupled to a power supply line; a first switch for diode-connecting the first transistor in response to a selection signal to charge the first capacitor with a voltage corresponding to a threshold voltage of the first transistor; a second transistor for transferring the data signal from the data lines in response to a selection signal; a second capacitor for storing a voltage corresponding to the data signal; and a second switch for isolating the second main electrode of the first transistor from the luminescent element during voltage-charging of the first capacitor in response to a control signal.

21 Claims, 7 Drawing Sheets

U.S. PATENT DOCUMENTS

| | | | | |
|---|---|---|---|---|
| 2002/0196213 | A1* | 12/2002 | Akimoto et al. | 345/82 |
| 2003/0085664 | A1* | 5/2003 | Bae | 315/169.1 |
| 2003/0103022 | A1* | 6/2003 | Noguchi et al. | 345/77 |
| 2004/0004589 | A1* | 1/2004 | Shih | 345/82 |
| 2004/0046719 | A1* | 3/2004 | Wang et al. | 345/82 |
| 2004/0051685 | A1* | 3/2004 | Chung et al. | 345/82 |
| 2005/0156829 | A1 | 7/2005 | Choi et al. | |

FOREIGN PATENT DOCUMENTS

| | | |
|---|---|---|
| JP | 2003-223138 | 8/2003 |
| JP | 2005-520191 | 7/2005 |

OTHER PUBLICATIONS

European Search Report, dated Nov. 11, 2004, for Application No. 03090421.3, in the name of Samsung SDI Co., Ltd.

Patent Abstracts of Japan, Publication No. 2003-108067, dated Apr. 11, 2003, in the name of Shoichiro Matsumoto.

Patent Abstracts of Japan, Publication No. 2003-223138, dated Aug. 8, 2003, in the name of Hajime Kimura.

* cited by examiner

LUMINESCENT DISPLAY, AND DRIVING METHOD AND PIXEL CIRCUIT THEREOF, AND DISPLAY DEVICE

CROSS REFERENCE TO RELATED APPLICATION

This application claims priority to and the benefit of Korean Patent Application No. 2003-0003975 filed on Jan. 21, 2003 in the Korean Intellectual Property Office, the content of which is incorporated herein by reference.

BACKGROUND OF THE INVENTION (a) Field of the Invention

The present invention relates to a luminescent display, and a driving method and pixel circuit thereof. More specifically, the present invention relates to an organic electroluminescent (hereinafter referred to as "EL") display.

(b) Description of the Related Art

In general, an organic EL display is a display that emits light by electrical excitation of fluorescent organic compound and displays images by driving each of N×M organic luminescent cells with voltage or current. These organic luminescent cells have a structure that includes an anode (indium tin oxide: ITO) layer, an organic thin film, and a cathode (metal) layer. For a good electron-hole balance to enhance luminescent efficiency, the organic thin film is of a multi-layer structure that includes an emitting layer (EML), an electron transport layer (ETL), and a hole transport layer (HTL). The multi-layer structure can also include an electron injecting layer (EIL), and a hole injecting layer (HIL).

There are two driving methods for the organic luminescent cells: one is a passive matrix driving method and the other is an active matrix driving method using TFTs or MOSFETs. In the passive matrix driving method, anode and cathode stripes are arranged perpendicular to each other to selectively drive the lines. Contrarily, in the active matrix driving method, a TFT and a capacitor are coupled to each ITO pixel electrode to sustain a voltage by the capacity of the capacitor.

FIG. 1 is a circuit diagram of a conventional pixel circuit for driving an organic EL element using TFTs. For simplicity reasons, only one of the N×M pixels is shown in FIG. 1.

As illustrated in FIG. 1, a current-driven transistor M2 is coupled to the organic EL element (OLED) to supply a current for light emission. The amount of current of the current-driven transistor M2 is controlled by the data voltage applied through a switching transistor M1. Here, a capacitor Cst for sustaining the applied voltage for a predetermined time period is coupled between the source and gate of the transistor M2. The gate of the transistor M1 is coupled to a selection signal line Select, and the source is coupled to the data line Vdata.

In the operation of the pixel of the above structure, when the transistor M1 is turned ON in response to the selection signal Select applied to the gate of the switching transistor M1, the data voltage Vdata is applied to the gate of the driving transistor M2 through the data line. In response to the data voltage Vdata applied to the gate, a current flows to the organic EL element (OLED) through the transistor M2 to emit light.

The current flowing to the organic EL element (OLED) is given by the following equation:

$$I_{OLED} = \frac{\beta}{2}(Vgs - Vth)^2 = \frac{\beta}{2}(Vdd - Vdata - |Vth|)^2 \quad \text{[Equation 1]}$$

where $I_{OLED}$ is the current flowing to the organic EL element (OLED); Vgs is the voltage between the source and gate of the transistor M2; Vth is the threshold voltage of the transistor M2; Vdata is the data voltage; and β is a constant.

As can be seen from the equation 1, according to the pixel circuit of FIG. 1, the current corresponding to the applied data voltage Vdata is supplied to the organic EL element (OLED), which emits light by the supplied current.

Typically, the pixel driving voltage Vdd is constructed as a horizontal or vertical line for supplying the power to the driving transistor of each cell. When the pixel driving voltage Vdd is constructed as a horizontal line as illustrated in FIG. 2 and there are many turned-on driving transistors in the cell coupled to each branched Vdd line, a high current flows to the corresponding Vdd line, and the voltage difference between the right and left sides of the line increases.

This voltage drop in the voltage line Vdd is proportional to the amount of current, which is dependent upon the number of turned-on pixels among the pixels coupled to the corresponding line. So, the voltage drop is also changed depending on the number of turned-on pixels. In FIG. 2, the driving voltage Vdd applied to the right-handed pixel of the line is lower than the driving voltage Vdd applied to the left-handed pixel, and the voltage Vgs applied to the driving transistor located at the right-handed pixel is lower than the voltage Vgs applied to the driving transistor at the left-handed pixel, thereby causing a difference in the amount of current flowing to the transistors and hence a brightness difference.

Despite having the same voltage Vgs, the amount of current supplied to the organic EL element (OLED) changes causing a brightness difference, due to changes in the threshold voltage Vth of the TFT. Changes in the threshold voltage Vth of the TFT occurs due to the non-uniformity of the manufacturing process.

FIG. 3 is a circuit diagram of a pixel circuit derived to solve the above problem and to avoid the non-uniformity of brightness caused by the variation of the threshold voltage Vth of the driving transistor. FIG. 4 is a driving timing diagram for the circuit of FIG. 3.

In this circuit, however, the data voltage for the driving transistor M2 must be equal to the driving voltage Vdd while AZ signal is LOW. The source-gate voltage of the driving transistor is given by the following equation:

$$Vgs = Vth + \frac{C1}{C1 + C2}(Vdd + Vdata) \quad \text{[Equation 2]}$$

where Vth is the threshold voltage of the transistor M2; Vdata is the data voltage; and Vdd is the driving voltage.

As can be seen from the equation 2, there is a problem because the swing width of the data voltage or the value of the capacitor C1 must be large enough because the data voltage is divided by the capacitors C1 and C2.

SUMMARY OF THE INVENTION

In one embodiment, the present invention is an organic EL display that compensates for the deviation of the threshold voltage of a TFT driving transistor to represent uniform brightness.

In one embodiment, the present invention is an organic EL display that compensates for the difference in the voltage drop among pixels caused in the driving voltage Vdd line to represent uniform brightness.

In one aspect of the present invention, a luminescent display includes: a plurality of data lines each of the plurality of data lines transferring a data signal representing an image signal; a plurality of scan lines each of the plurality of scan lines transferring a selection signal thereon; a plurality of pixel circuits formed at a corresponding pixel of a plurality of pixels defined by the plurality of data lines and the plural scan lines; and a power supply line coupled to each pixel circuit. Each pixel circuit includes: a luminescent element for emitting light corresponding to an amount of current applied; a first capacitor; a first transistor having a control electrode thereof coupled to the first capacitor, and a first main electrode thereof coupled to the power supply line; a first switch for diode-connecting the first transistor in response to a selection signal from a previous scan line for a pixel that was previously scanned to charge the first capacitor with a voltage corresponding to a threshold voltage of the first transistor; a second transistor for transferring the data signal from the data lines in response to a selection signal from a present scan line for a pixel that is being presently scanned; a second capacitor coupled between the power supply line and the second transistor for storing a voltage corresponding to the data signal; and a second switch for electrically isolating a second main electrode of the first transistor from the luminescent element during voltage-charging of the first capacitor in response to a control signal. The first transistor supplies a current corresponding to the sum of the voltages charged in the first and second capacitors.

In one embodiment, the first switch includes: a third transistor coupled between the power supply line and the first capacitor for applying a voltage from the power supply line to the first capacitor in response to the selection signal from the previous scan line; and a fourth transistor coupled between a control electrode and the second main electrode of the first transistor for diode-connecting the control and first main electrodes of the first transistor in response to the selection signal from the previous scan line.

In one embodiment, the second to fourth transistors are transistors of the same conductivity type.

In one embodiment, the control signal is the selection signal from the previous scan line. The second switch includes a third transistor that is turned off in response to the control signal and coupled between the second main electrode of the first transistor and the luminescent element.

In one embodiment, the second switch includes a third transistor coupled between the second main electrode of the first transistor and the luminescent element. The control signal is a selection signal from a separate scan line, and it turns on the third transistor.

In one embodiment, the control signal includes the selection signal from the previous scan line, and the selection signal from the present scan line. The second switch includes third and fourth transistors that are coupled in series between the second main electrode of the first transistor and the luminescent element, and that have a control electrode thereof coupled to the previous scan line and the present scan line, respectively.

In another exemplary embodiment of the present invention, there is provided a pixel circuit for a luminescent display, in which plural pixel circuits are formed in a plurality of pixels defined by a plurality of data lines and a plurality of scan lines The pixel circuit includes: a luminescent element; a first transistor having a first main electrode thereof coupled to a power supply line, and supplying a current for light-emission of the luminescent element; first and second capacitors coupled in series between the power supply line and the control electrode of the first transistor; a second transistor having a control electrode thereof coupled to a present scan line for a pixel that is being presently scanned, and a first and a second main electrodes thereof coupled to the data line and the first and second capacitors, respectively; a third transistor having a control electrode thereof coupled to a previous scan line for a pixel that was previously scanned, and coupled between the power supply line and the first and second capacitors; and a fourth transistor having a control electrode thereof coupled to the previous scan line, and being coupled between the second capacitor and the drain electrode of the first transistor. The first transistor supplies a current corresponding to a voltage charged in the first and second capacitors.

In one embodiment, the third and fourth transistors are transistors of the same conductivity type.

In one embodiment, the pixel circuit further includes a switch coupled between the first transistor and the luminescent element having a control terminal thereof for receiving a control signal.

In one embodiment, the control signal is a selection signal from the previous scan line. The switch includes a fifth transistor coupled between a second main electrode of the first transistor and the luminescent element and that is turned off in response to the control signal.

In one embodiment, the switch includes a fifth transistor coupled between the second main electrode of the first transistor and the luminescent element. The control signal is a selection signal from a separate scan line for turning on the fifth transistor.

In one embodiment, the control signal includes a selection signal from the previous scan line and a selection signal from the present scan line. The switch includes fifth and sixth transistors having a gate electrode thereof coupled to the previous scan line and the scan line. The fifth and sixth transistors are coupled in series between the second main electrode of the first transistor and the luminescent element.

In still another exemplary embodiment of the present invention, there is provided a method for driving a luminescent display, which includes a data line, a scan line intersecting the data lines, and a pixel formed in area defined by the data line and the scan line and having a transistor for supplying a current to a luminescent element. The method includes: compensating a gate voltage of the transistor in response to a previous selection signal for selecting a first pixel that was previously scanned coupled to a previous scan line; applying a selection signal for selecting the pixel coupled to the scan line; and receiving the data voltage from the data line in response to the selection signal, and supplying a current corresponding to the sum of the compensated gate voltage and the data voltage to the luminescent element.

In one embodiment, the method further includes: interrupting a supply of the current to the luminescent element while the data voltage is applied from the data line in response to the control signal.

In one embodiment, the control signal is the selection signal, or a selection signal from a separate scan line.

In still yet another exemplary embodiment of the present invention, there is provided a display device comprising: a display element for displaying a portion of an image in response to a current being applied; a transistor having a first main electrode coupled to a voltage source; a first capacitor coupled to a control electrode of the first transistor for charging a first voltage corresponding to a threshold voltage of the transistor; and a first switch coupled between a second main electrode of the transistor and the display element for intercepting the current supplied to the display element from the transistor.

In one embodiment, the first voltage is charged in the first capacitor during a first period, and the second voltage is charged in the second capacitor during a second period. In addition, The first and second periods may not be superimposed.

In one embodiment, the first switch intercepts the current during the first period or the second period.

In one embodiment, the display device comprises a second switch coupled in parallel to the second capacitor, and the second switch is turned on to discharge the second capacitor.

BRIEF DESCRIPTION OF THE DRAWINGS

The accompanying drawings, which are incorporated in and constitute a part of the specification, illustrate exemplary embodiments of the invention, and, together with the description, serve to explain the principles of the invention.

DETAILED DESCRIPTION

In the following detailed description, general exemplary embodiments of the invention has been shown and described. As will be realized, the invention is capable of modification in various obvious respects, all without departing from the invention. Accordingly, the drawings and description are to be regarded as illustrative in nature, and not restrictive.

Figure 1:
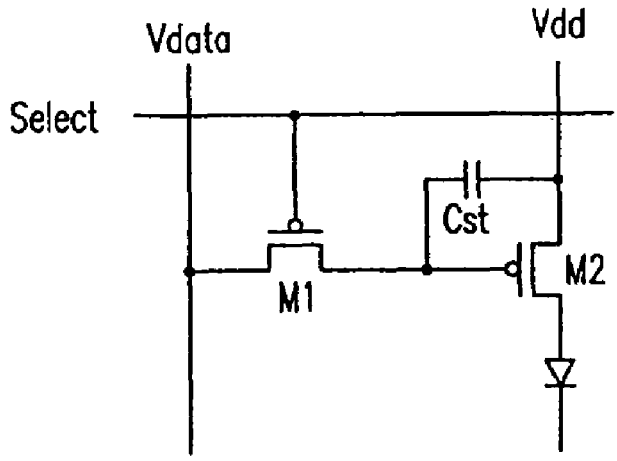
FIG.1 (PRIOR ART)
FIG. 1 is a circuit diagram of a conventional pixel circuit for driving an organic EL element.
Figure 2:
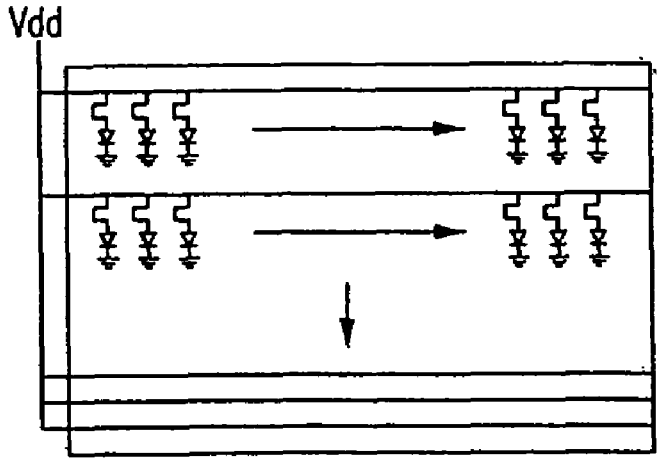
FIG.2 (PRIOR ART)
FIG. 2 is a diagram showing the construction of a driving voltage Vdd parallel to scan lines in a general circuit for driving the organic EL element of FIG. 1.
Figure 3:
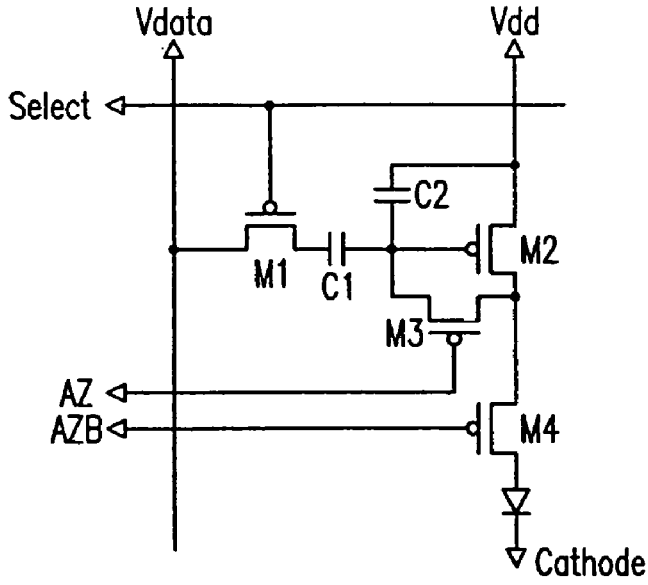
FIG.3 (PRIOR ART)
FIG. 3 is a circuit diagram of a conventional pixel circuit for preventing non-uniformity of brightness caused by a variation of threshold voltage Vth of the driving transistor.
Figure 4:
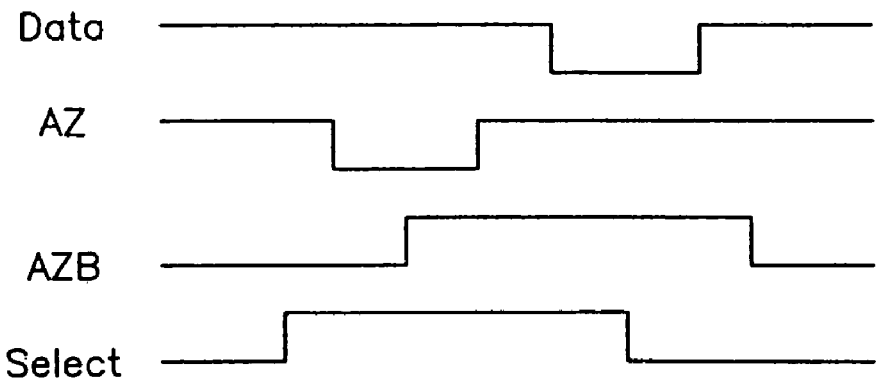
FIG.4 (PRIOR ART)
FIG. 4 is a driving timing diagram for the circuit of FIG. 3.
Figure 5:
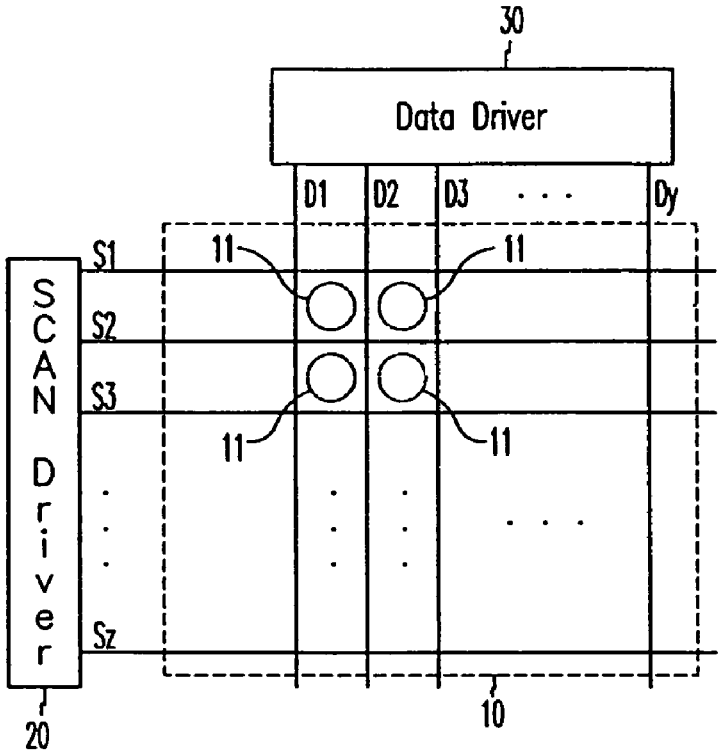
FIG. 5 is a diagram of an organic EL display according to an embodiment of the present invention.

FIG. 5 is a schematic plan diagram of an organic EL display according to an embodiment of the present invention.

The organic EL display according to the embodiment of the present invention comprises, as shown in FIG. 5, an organic EL display panel 10, a scan driver 20, and a data driver 30.

The organic EL display panel 10 comprises a plurality of data lines $D_1$ to $D_y$ for transferring data signals representing image signals; a plurality of scan lines $S_1$ to $S_z$ for transferring selection signals; and a plurality of pixel circuits 11, each formed in a pixel area defined by two adjacent data lines and two adjacent scan lines. The data driver 30 applies a data voltage representing image signals to the plural data lines $D_1$ to $D_y$, and the scan driver 20 sequentially applies the selection signal to the plural scan lines $S_1$ to $S_z$.

Figure 6:
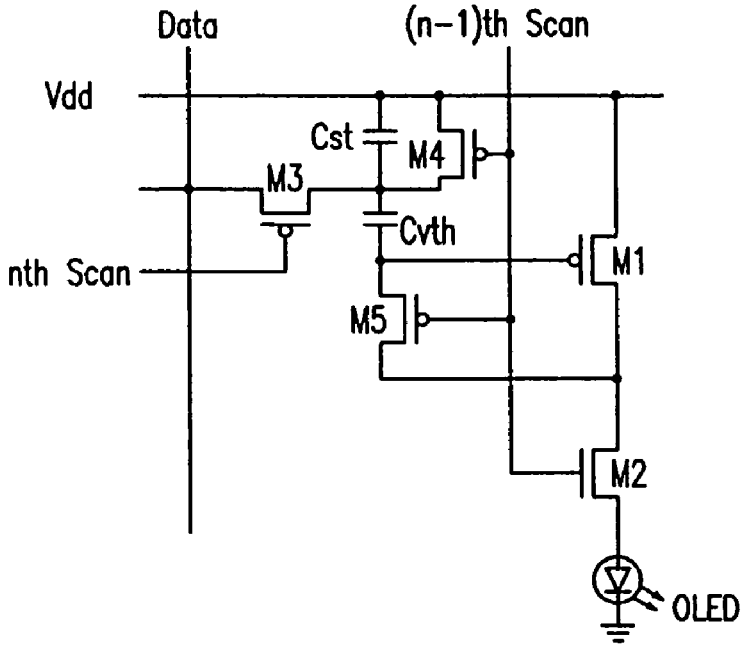
FIG. 6 is a circuit diagram of a pixel circuit according to a first embodiment of the present invention.

FIG. 6 is a circuit diagram of a pixel circuit 11 according to a first embodiment of the present invention.

The pixel circuit 11 comprises, as shown in FIG. 6, an organic EL element (OLED), transistors M1 to M5, and capacitors Cst and Cvth according to the first embodiment of the present invention.

The organic EL element (OLED) emits light corresponding to the amount of current applied. The current-driven transistor M1 has a source electrode, which is one of two main electrodes, coupled to a driving voltage Vdd, and a drain electrode, which is the other main electrode, coupled to the source electrode of the transistor M2. The transistor M1 outputs a driving current corresponding to the voltage applied between its gate and source. The transistor M2, which is coupled between the transistor M1 and the organic EL element (OLED), transfers the driving current from the transistor M1 to the organic EL element (OLED). The selection transistor M3 has a drain electrode, which is one of two main electrodes, coupled to the source electrode, which is the other main electrode of the transistor M4, a source electrode coupled to the data line Data, and a gate electrode, which is a control electrode, coupled to the n-th scan line. The drain electrode of the transistor M4 is coupled to the voltage Vdd. The gate electrodes of the transistors M2, M4, and M5 are coupled to the (n−1)-th scan line. According to the pixel circuit of FIG. 6, the current-supplying transistor M1 and the selection transistors M3, M4, and M5 are all PMOS type TFTs, and the selection transistor M2 is an NMOS TFT.

The capacitors Cst and Cvth are coupled in series between the driving voltage Vdd and the gate of the transistor M1. The data line Data is coupled between the capacitors Cst and Cvth through the selection transistor M3.

Next, the operation of the pixel circuit according to the first embodiment of the present invention in FIG. 6 will be described with reference to FIGS. 7A, 7B, 8A, and 8B.

Figure 7A:
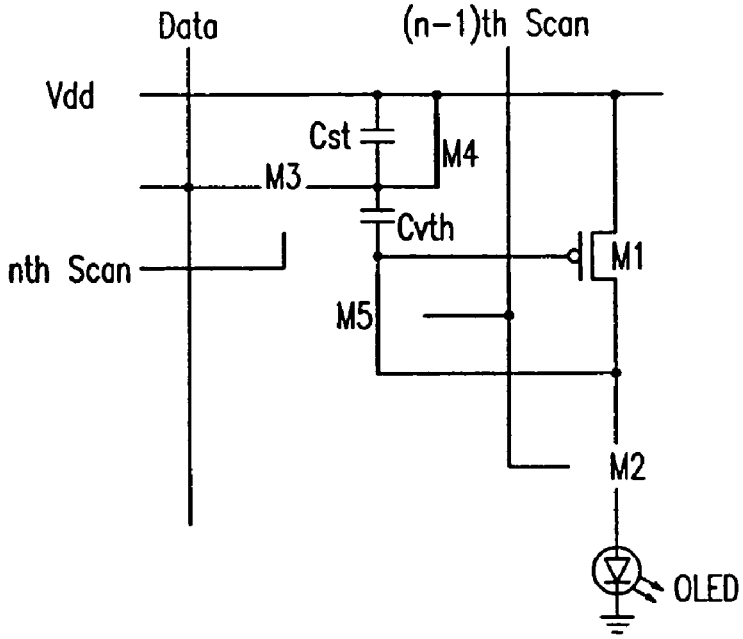
FIG. 7A is a diagram showing the operation of the pixel circuit according to the first embodiment of the present invention when the (n−1)-th scan line signal is applied.
Figure 7B:
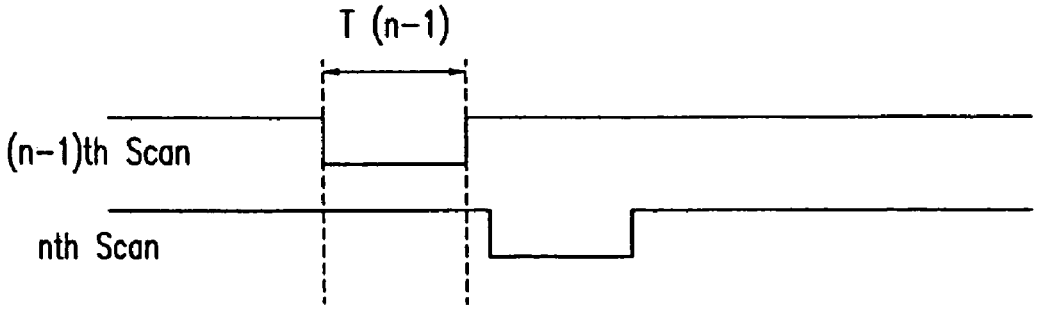
FIG. 7B is a driving timing diagram for the circuit of FIG. 7A.

For a time T(n−1), as shown in FIG. 7B, the previous scan line for a pixel that was scanned previous to the pixel that is being presently scanned, i.e., the (n−1)-th, or previous scan line, is selected to apply a low signal to the (n−1)-th scan line and a high signal to the n-th scan line for a pixel that is being presently scanned, or the present scan line. During this time, the transistors M4 and M5 are turned on and the transistor M2 is turned off, as shown in FIG. 7A. Also, the transistor M3 having its gate coupled to the n-th scan line is turned off. Accordingly, the transistor M4 having its gate and source shorted, performs a diode function for the driving voltage Vdd. The threshold voltage Vth of the transistor M1 is thus stored in the capacitor Cvth, because the capacitor Cst is shorted by the turned on transistor M4.

Figure 8A:
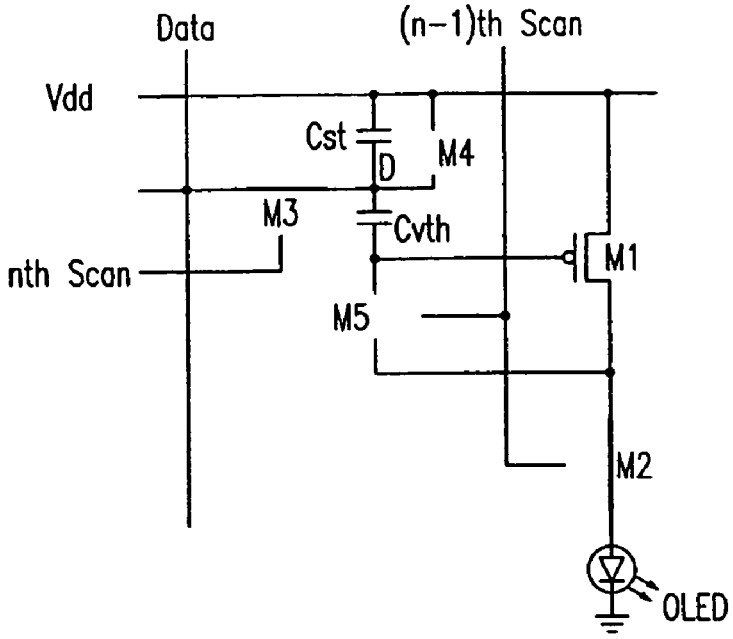
FIG. 8A is a diagram showing the operation of the pixel circuit according to the first embodiment of the present invention when the n-th scan line signal is applied.
Figure 8B:
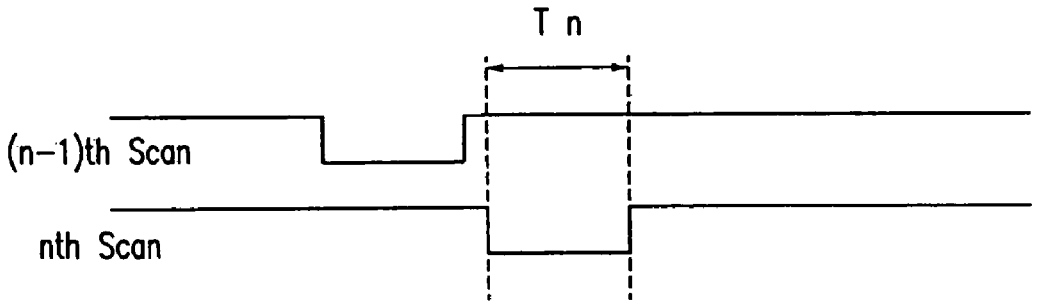
FIG. 8B is a driving timing diagram for the circuit of FIG. 8A.

For a time Tn, as shown in FIG. 8B, the n-th scan line (nth Scan) is selected to apply a low signal to the n-th scan line and a high signal to the (n−1)-th scan line ((n−1)th Scan). During this time period, the transistors M4 and M5 are turned off and the transistor M2 is turned on, as shown in FIG. 8A. The transistor M3 having its gate coupled to the n-th scan line (nth Scan) is also turned on. Due to the data voltage Vdata from the data line Data, the voltage of the node D is changed to the data voltage Vdata. The gate voltage of the transistor M1 amounts to Vdata−Vth, because the threshold voltage Vth of the transistor M1 is stored in the capacitor Cvth.

Namely, the gate-source voltage of the transistor M1 is given by the equation 3, and the current $I_{OLED}$ of the equation 4 is supplied to the organic EL element (OLED) through the transistor M1.

$$Vgs=Vdd-(Vdata-Vth) \quad \text{[Equation 3]}$$

$$I_{OLED}=\frac{\beta}{2}(Vgs-Vth)^2=\frac{\beta}{2}(Vdd-Vdata)^2 \quad \text{[Equation 4]}$$

where Vdd is the driving voltage; Vdata is the data voltage; and Vth is the threshold voltage of the transistor M1.

As can be seen from the equation 3, even though the threshold voltage Vth of the transistor M1 differs from pixel to pixel, the data voltage Vdata compensates for the deviation of the threshold voltage Vth to supply a constant current supplied to the organic EL element (OLED), thus solving the problem with the non-uniformity of brightness according to the position of the pixel.

As stated above, when a current flows to the driving transistor M1 while the data voltage Vdata is applied, the driving voltage Vdd drops due to the resistance of the supply line of the driving voltage Vdd. The voltage drop in this case is proportional to the amount of current flowing to the supply line of the driving voltage Vdd. Accordingly, with the same data voltage Vdata applied, the voltage Vgs applied to the driving transistor is changed to vary the current, causing non-uniformity of brightness.

Figure 9A:
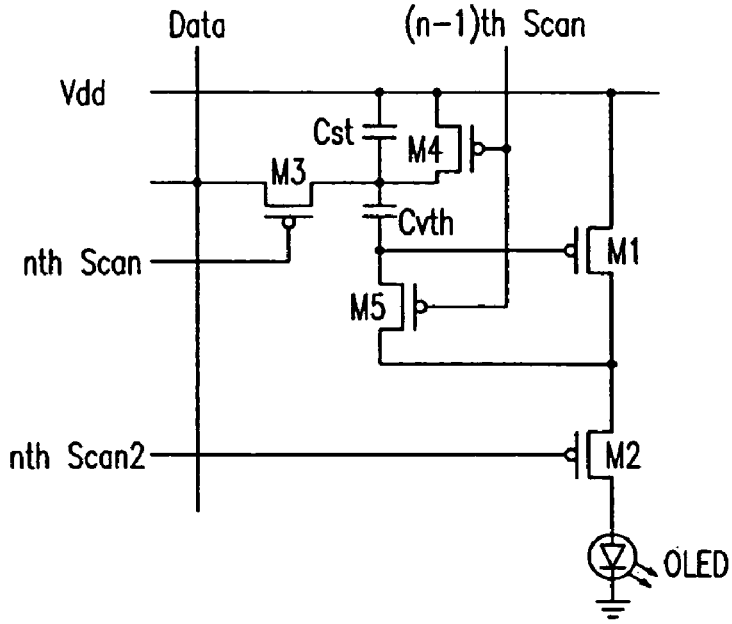
FIG. 9*a* is a circuit diagram of a pixel circuit according to a second embodiment of the present invention.
Figure 9B:
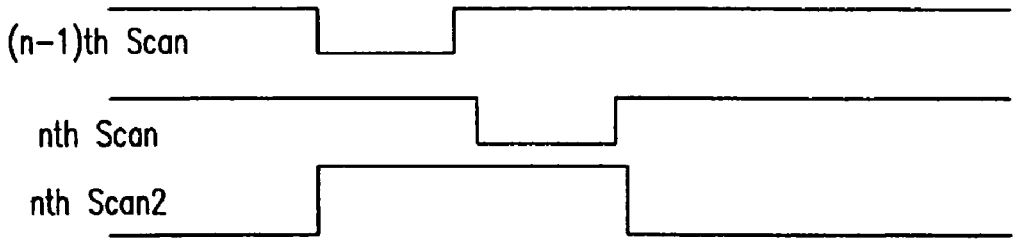
FIG. 9*b* is a scan timing diagram for the circuit of FIG. 9*a;*

FIG. 9A is a circuit diagram of a pixel circuit according to a second embodiment of the present invention that prevents a change of the voltage Vgs (of the M1 transistor) by interrupting the current to the driving transistor M1 while the data voltage Vdata is applied, in the case where the supply line of the driving voltage Vdd is arranged in the same direction as the scan line. FIG. 9B is a scan timing diagram of the pixel circuit of FIG. 9A.

As illustrated in FIG. 9A, the NMOS transistor M2 the gate of which is coupled to the previous scan line ((n−1)th Scan) in the circuit of FIG. 6, is replaced with the PMOS transistor M2 and a separate scan line (nth Scan2) for controlling the transistor M2 is connected to the gate of the new transistor M2.

Namely, as illustrated in FIG. 9B, a high signal is applied to the scan line (nth Scan2) while a low signal is sequentially applied to the (n−1)-th and n-th scan lines ((n−1)th Scan and nth Scan), to turn the transistor M2 off. Thus current is prevented from flowing to the transistor M1 while the data voltage Vdata is applied.

No voltage drop occurs on the driving voltage Vdd line, because no current flows to the n-th driving voltage Vdd line. Despite a voltage drop after applying the data voltage Vdata, the transistor voltage Vgs of each pixel is not changed, thereby preventing non-uniformity of brightness caused by the voltage drop of the driving voltage Vdd.

The circuit of FIG. 9A, which has a separate scan line for controlling the transistor M2, requires a circuit for generating a signal to be applied to this scan line.

Figure 10A:
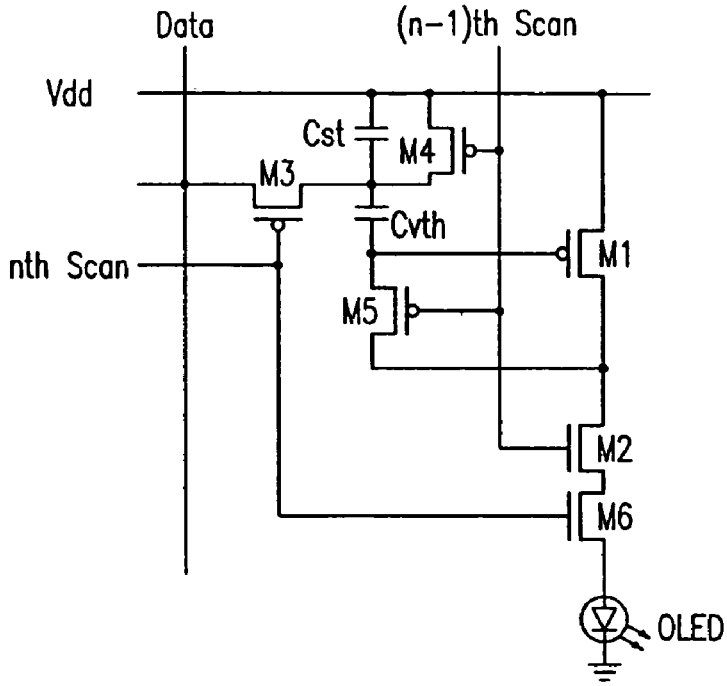
FIG. 10*a* is a circuit diagram of a pixel circuit according to a third embodiment of the present invention.
Figure 10B:
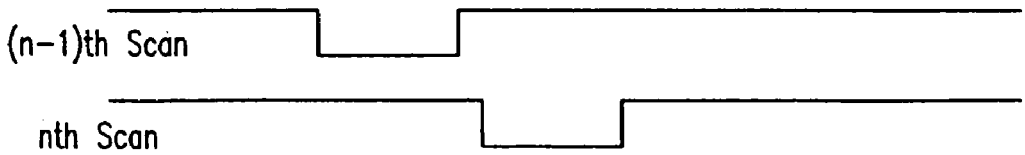
FIG. 10*b* is a scan timing diagram for the circuit of FIG. 10*a.*

FIG. 10A is a circuit diagram of a pixel circuit according to a third embodiment of the present invention which does not require a circuit for generating a new signal. FIG. 10B is a scan timing diagram of the circuit of FIG. 10A.

The pixel circuit according to the third embodiment of the present invention adds, as illustrated in FIG. 10A, an NMOS transistor M6 between the transistor M2 and the organic EL element (OLED) of the circuit of FIG. 6. The gate of the transistor M6 is coupled to the n-th scan line (nth Scan).

Namely, as illustrated in FIG. 10B, the transistor M2 is short-circuited with a low signal applied to the (n−1)-th scan line ((n−1)th Scan), and the transistor M6 is short-circuited with a low signal applied to the n-th scan line (nth Scan), thereby preventing a current flowing to the transistor M1 while the data voltage Vdata is applied.

No voltage drop occurs on the driving voltage Vdd line, because no current flows to the n-th driving voltage Vdd line. Despite a voltage drop after applying the data voltage Vdata, the driving transistor voltage Vgs of each pixel is not changed, thereby preventing non-uniformity of brightness caused by the voltage drop of the driving voltage Vdd. In addition, the gate of the transistor M6 is coupled to the n-th scan line (nth Scan) for the control of the transistor M6, so there is no need for an additional circuit for generating a control signal.

The transistor M6 may be disposed at any position between the driving voltage Vdd and the cathode power source.

As described above, the present invention effectively compensates for the deviation of the threshold voltage of the TFT for driving an organic EL element to prevent non-uniformity of brightness.

Furthermore, the present invention prevents non-uniformity of brightness caused by a voltage drop of the driving power line when the driving power line is arranged in the same direction of the scan line.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A luminescent display comprising:

a plurality of data lines for transferring thereon a data signal representing an image;

a plurality of scan lines, each of the plurality of scan lines transferring a selection signal;

a plurality of pixel circuits, each of the plurality of pixel circuits formed at a corresponding pixel of a plurality of pixels defined by the plurality of data lines and the plurality of scan lines; and a power supply line coupled to each of the plurality of pixel circuits, each of the plurality of pixel circuits comprising:

a luminescent element for emitting light corresponding to an amount of current applied;

a first capacitor;

a first transistor having a control electrode thereof coupled to the first capacitor, and a first main electrode thereof coupled to the power supply line;

a first switch for diode-connecting the first transistor in response to a selection signal from a previous scan line for a pixel that was previously scanned to charge the first capacitor with a voltage corresponding to a threshold voltage of the first transistor;

a second transistor for transferring the data signal from the data lines in response to a selection signal from a present scan line for a pixel that is being presently scanned;

a second capacitor coupled between the power supply line and the second transistor for storing a voltage corresponding to the data signal; and a second switch for electrically isolating a second main electrode of the first transistor from the luminescent element during voltage-charging of the first capacitor in response to a control signal, the first transistor supplying a current corresponding to the sum of the voltages charged in the first and second capacitors.

2. The luminescent display as claimed in claim 1, wherein the first switch comprises:

a third transistor for applying a voltage from the power supply line to the first capacitor in response to the selection signal from the previous scan line; and a fourth transistor for diode-connecting the first transistor in response to the selection signal from the previous scan line.

3. The luminescent display as claimed in claim 2, wherein the second, third, and fourth transistors are transistors of the same conductivity type.

4. The luminescent display as claimed in claim 1, wherein the control signal is the selection signal from the previous scan line, and the second switch comprises a third transistor being turned off in response to the control signal and coupled between the first transistor and the luminescent element.

5. The luminescent display as claimed in claim 1, wherein the second switch comprises a third transistor coupled between the first transistor and the luminescent element, and the control signal is a selection signal from a separate scan line for turning on the third transistor.

6. The luminescent display as claimed in claim 1, wherein the control signal includes the selection signal from the previous scan line, and the selection signal from the present scan line, and the second switch comprises third and fourth transistors coupled in series between the first transistor and the luminescent element and having their control electrodes coupled to the previous scan line and the present scan line, respectively.

7. A pixel circuit for a luminescent display, in which plural pixel circuits are formed in a plurality of pixels defined by a plurality of data lines and a plurality of scan lines, comprising:

a luminescent element;

a first transistor having a first main electrode thereof coupled to a power supply line, and supplying a current for light-emission of the luminescent element;

first and second capacitors coupled in series between the power supply line and the control electrode of the first transistor;

a second transistor having a control electrode thereof coupled to a present scan line for a pixel that is being presently scanned, and a first and a second main electrodes thereof coupled to a data line of the plurality of data lines and the first and second capacitors, respectively;

a third transistor having a control electrode thereof coupled to a previous scan line for a pixel that was previously scanned, and coupled between the power supply line and the first and second capacitors; and a fourth transistor having a control electrode thereof coupled to the previous scan line, and being coupled between the second capacitor and the second main electrode of the first transistor, the first transistor supplying a current corresponding to a voltage charged in the first and second capacitors.

8. The pixel circuit as claimed in claim 7, wherein the third and fourth transistors are transistors of the same conductivity type.

9. The pixel circuit as claimed in claim 7, further comprising:

a switch coupled between the first transistor and the luminescent element having a control terminal thereof for receiving a control signal.

10. The pixel circuit as claimed in claim 9, wherein the control signal is a selection signal from the previous scan line, and the switch comprises a fifth transistor coupled between the first transistor and the luminescent element and being turned off in response to the control signal.

11. The pixel circuit as claimed in claim 9, wherein the switch comprises a fifth transistor coupled between the first transistor and the luminescent element, and the control signal is a selection signal from a separate scan line for turning on the fifth transistor.

12. The pixel circuit as claimed in claim 9, wherein the control signal includes a selection signal from the previous scan line and a selection signal from the present scan line, and the switch comprises fifth and sixth transistors each having a gate electrode thereof coupled to the previous scan line and the present scan line, respectively, the fifth and sixth transistors being coupled in series between the first transistor and the luminescent element.

13. A method for driving a luminescent display, which includes a data line, a scan line intersecting the data line, and a pixel formed in an area defined by the data line and the scan line and having a transistor for supplying a current to a luminescent element, the method comprising:

compensating a gate voltage of the transistor in response to a previous selection signal for selecting a first pixel coupled to a previous scan line for a pixel that was previously scanned;

applying a selection signal for selecting the pixel coupled to the scan line; and receiving a data voltage from the data line in response to the selection signal, and supplying a current corresponding to the sum of the compensated gate voltage and the data voltage to the luminescent element.

14. The method as claimed in claim 13, further comprising:

interrupting a supply of the current to the luminescent element while the data voltage is applied from the data line, in response to the control signal.

15. The method as claimed in claim 14, wherein the control signal is the previous selection signal.

16. The method as claimed in claim 14, wherein the control signal is a selection signal from a separate scan line.

17. A display device comprising:

a display element for displaying a portion of an image in response to a current being applied;

a transistor having a main electrode coupled to a voltage source;

a first capacitor for charging a first voltage corresponding to a threshold voltage of the transistor; and a first switch, coupled between the transistor and the display element for intercepting a current supplied to the display element from the transistor, wherein the first voltage is charged in the first capacitor during a first period, and a second voltage is charged in a second capacitor during a second period.

18. The display device of claim 17, wherein the first and second periods are not superimposed.

19. The display device of claim 17, wherein the first switch intercepts the current supplied to the display element during the first period.

20. The display device of claim 17, wherein the first switch intercepts the current supplied to the display element during the second period.

21. The display device of claim 17, further comprising a second switch coupled in parallel to the second capacitor, wherein the second switch is turned on to discharge the second capacitor.

* * * * *

UNITED STATES PATENT AND TRADEMARK OFFICE

CERTIFICATE OF CORRECTION

PATENT NO. : 7,277,071 B2
APPLICATION NO. : 10/734003
DATED : October 2, 2007
INVENTOR(S) : Choon-Yul Oh It is certified that error appears in the above-identified patent and that said Letters Patent is hereby corrected as shown below:

| | |
|---|---|
| Column 9, line 61, Claim 7 | Delete "electrodes",<br>Insert --electrode-- |

Signed and Sealed this

Twenty Second Day of April, 2008

JON W. DUDAS
*Director of the United States Patent and Trademark Office*